United States Patent [19]

Gronbeck et al.

[11] 4,442,920

[45] Apr. 17, 1984

[54] COLLAPSIBLE LADDER

[75] Inventors: Peter W. Gronbeck, Highlands; Dennis Mullaney, Belford; Kimberly M. Smith, Colts Neck, all of N.J.

[73] Assignee: Steelstran Industries, Incorporated, Matawan, N.J.

[21] Appl. No.: 430,593

[22] Filed: Sep. 30, 1982

[51] Int. Cl.[3] ..... E06C 1/56

[52] U.S. Cl. ..... 182/199; 182/46; 182/228

[58] Field of Search ..... 182/196, 197, 198, 199, 182/142, 46, 130, 228, 194, 70, 73, 74, 150

[56] References Cited

U.S. PATENT DOCUMENTS

| | | | |
|---|---|---|---|
| 149,328 | 4/1874 | Mulford | 182/196 |
| 366,825 | 7/1887 | French | 182/196 |
| 641,741 | 1/1900 | Travers . | |
| 763,274 | 6/1904 | Foster | 182/130 |
| 800,934 | 10/1905 | McArthur . | |
| 898,286 | 9/1908 | Toupin . | |
| 899,552 | 9/1908 | McArthur . | |
| 1,349,125 | 8/1920 | Full . | |
| 1,611,768 | 3/1923 | Mitchell . | |
| 2,079,034 | 5/1936 | Parkin . | |
| 2,373,346 | 8/1943 | Schneider . | |
| 2,638,260 | 7/1952 | Skolmen . | |
| 3,008,537 | 11/1961 | Roberts | 182/196 |
| 3,043,399 | 7/1962 | Marryatt | 182/196 |
| 3,077,241 | 2/1963 | Klages . | |
| 3,415,341 | 12/1968 | Hostetler . | |
| 4,177,878 | 12/1979 | Salvarezza . | |
| 4,241,809 | 12/1980 | Salvarezza . | |

FOREIGN PATENT DOCUMENTS

| | | | |
|---|---|---|---|
| 277906 | 2/1965 | Australia | 182/196 |
| 1784377 | 8/1968 | Fed. Rep. of Germany | 182/198 |
| 471433 | 7/1914 | France . | |
| 887006 | 7/1943 | France | 182/199 |
| 43380 | 6/1938 | Netherlands . | |
| 217766 | 6/1924 | United Kingdom . | |
| 496194 | 11/1938 | United Kingdom . | |
| 599349 | 3/1948 | United Kingdom . | |
| 798371 | 7/1958 | United Kingdom . | |
| 935645 | 9/1963 | United Kingdom . | |

*Primary Examiner*—R. P. Machado

*Attorney, Agent, or Firm*—Lerner, David, Littenberg, Krumholz & Mentlik

[57] ABSTRACT

A collapsible ladder which includes a plurality of platforms suspended from several rope segments. The rope segments are placed in open-ended notches disposed in the platforms and are clamped thereto by a plurality of clamp means, the clamp means being divided in half, each half engaging one notch and the rope therein and being clamped by an elongated fastener to the other half of the clamp means which engages another notch and the rope therein. As a result of this configuration, the elongated platforms, if damaged, can be changed individually without necessity of removal of other than the damaged platform.

18 Claims, 5 Drawing Figures

COLLAPSIBLE LADDER

BACKGROUND AND/OR ENVIRONMENT OF THE INVENTION

1. Field of the Invention

The present invention pertains to rope ladders, and more particularly to rope ladders wherein a damaged platform or rung thereof can be replaced without disengaging other than the damaged platform or rung from the rope or the like suspending the platforms or rungs.

2. Description of the Contemporary and/or Prior Art

Collapsible ladders, and more particularly ladders which have the platforms or rungs thereof suspended by flexible stiles, such as ropes or the like, have been put to various uses including shipboard applications. In such applications, the ladders usually are subjected not only to heavy use but also to a rather hostile environment. Therefore, it is essential that these ladders not only be sturdy and durable but they also must be serviceable in the event of wear or damage.

Various flexible ladders have been proposed which provide different means for affixing a rope, cable, or the like to a ladder platform, sometimes called a rung, wherein the rope passes through a hole disposed in the platform. Ladders configured in this manner are shown, for example, in U.S. Pat. Nos. 800,934, 898,286, 899,552, 1,611,768, 3,077,241, 4,177,878, and 4,241,809, and in British Pat. Nos. 217,766, 496,194, and 935,645. A common disadvantage of these ladders is that in the event one of the platforms thereof, disposed between other platforms, becomes damaged, other platforms in addition to the damaged platform must be disassembled from the rope in order to replace the damaged platform. In the case of some designs, numerous platforms have to be disengaged so that the entire ladder can be restrung. At best, this is a time consuming chore and where the ropes are affixed using lashing such as that shown in British Pat. Nos. 217,766, 496,194 and 935,645, a major reworking of the ladder is required.

One design avoiding the problem of having to remove several platforms of a ladder to replace a damaged platform is shown in U.S. Pat. No. 641,741 and British Pat. No. 599,349. In these ladder configurations a pair of ropes clamped together at spaced apart locations are employed. The platform ends are disposed between the clamped ropes. Although this will permit replacement of a single platform, a great sacrifice is made in terms of platform stability.

To enhance stability and to still provide the feature of being able to replace a single ladder platform, various ladder configurations have been proposed which provide a notch or slot into which a rope or cable can be clamped. While such ladder configurations do permit the desired platform removability, the means heretofore proposed for clamping the ropes or cables within the notches are less than optimum by a virtue of placing undue strain upon the ropes or cables employed, by permitting slippage of the platforms along the longitudinal axes of the ropes or cables, or by providing platforms which are not particularly stable.

U.S. Pat. Nos. 2,638,260 and 3,415,341 teach ladders which have rope type stiles that are retained within a recess in the edge of a rung. The ropes are straight when the ladder is in use and the rungs are affixed thereto through crimping engagement of elements which are disposed around the ropes and are engaged by the rungs. A crimping connection with a straight rope as taught in these two patents inherently suffers from loosening since most forces on the rungs will tend to open the crimps therefore causing rung slippage along the ropes. If the crimps are tightened to try to preclude slippage, it is likely that the rope will be damaged from abrasion.

British Pat. No. 798,371 teaches the retention of a rope in the notched end of a ladder rung by a compression type clamp. Such a configuration suffers from the same problems of slippage and/or rope damage as noted in regard to the previously mentioned patents which employ crimping engagement. In an apparent attempt to minimize the slippage problem, this patent teaches the crossing of the ropes between rungs.

An alternate approach is shown in U.S. Pat. No. 1,349,125 wherein a rung which is divided in half is provided. The halves of the rung are clamped around the ropes employed and protrusions are provided adjacent to the ropes so that the rungs will be somewhat limited in slippage. Unfortunately, uneven weight distribution will cause stress upon the fasteners used to join the rungs together and rung slippage or shearing of the fastener is possible.

Other rope ladder configurations are shown in U.S. Pat. Nos. 2,079,034 and 2,373,346 as well as French Pat. No. 471,433 and Dutch Pat. No. 43,380.

The present invention overcomes the problems associated with the prior art by providing a rope clamp for ladder platforms which firmly precludes slippage and which is divided into two halves that engage adjacent ropes disposed in rope notches located in a platform, the halves of the clamp being secured together in a fashion to cause the ropes to be securely sandwiched between the clamp halves and the rope notches.

SUMMARY OF THE INVENTION

Therefore, a primary object of the present invention is to provide a ladder which is collapsible.

A further object of the present invention is to provide a collapsible ladder which is sturdy and durable even in hostile marine environments.

A still further object of the present invention is to provide a collapsible ladder wherein the individual platforms or rungs thereof can be serviced without the necessity of disengaging other platforms or rungs from the flexible supporting stiles of the ladder.

Still another object of the present invention is to provide a collapsible ladder wherein the rungs or platforms thereof are firmly precluded from slipping along the provided supporting rope or cable.

Still another further object of the present invention is to provide a collapsible ladder which is simple in design, relatively inexpensive to manufacture, rugged in construction, easy to use, and efficient in operation.

These objects, as well as further objects and advantages of the present invention will become readily apparent after reading the ensuing description of a nonlimiting illustrative embodiment and viewing the accompanying drawing.

A collapsible ladder, according to the principles of the present invention, comprises a plurality of elongated platforms each having a pair of spaced apart longitudinal side edges and a pair of spaced apart transverse end edges, a first pair of adjacent notches being disposed in each of the platforms adjacent to one of the end edges thereof, the first notch of the first pair of notches opening through one of the side edges of the associated platform, the second notch of the first pair of notches opening through the other of the side edges of the associated platform, a second pair of adjacent notches being disposed in each of the platform adjacent to the other of the end edges, the first notch of the second pair of notches opening through one of the side edges of the associated platform, the second notch of the second pair of notches opening through the other of the side edges of the associated platform; a plurality of rope segments extending between the elongated platforms for supporting the platforms in a spaced apart use position, selected portions of selected rope segments being disposed in the first and second pairs of notches; and a plurality of clamp means, some of the clamp means for clamping selected portions of the selected rope segments in the first pairs of notches, the balance of the clamp means for clamping selected rope segments in the second pairs of notches, each of the clamp means being divided into two halves, a rope engaging portion of each half of each of the clamp means being dimensioned to reside within a corresponding notch, each of the clamp means including means for securing the halves thereof together to wedge the selected portions of the rope segments between the rope engaging portions of the clamp means halves and the elongated platforms.

BRIEF DESCRIPTION OF THE DRAWINGS

In order that the present invention may be more fully understood, it will now be described, by way of example, with reference to the accompanying drawing in which.

DESCRIPTION OF THE PREFERRED EMBODIMENT

Figure 1:
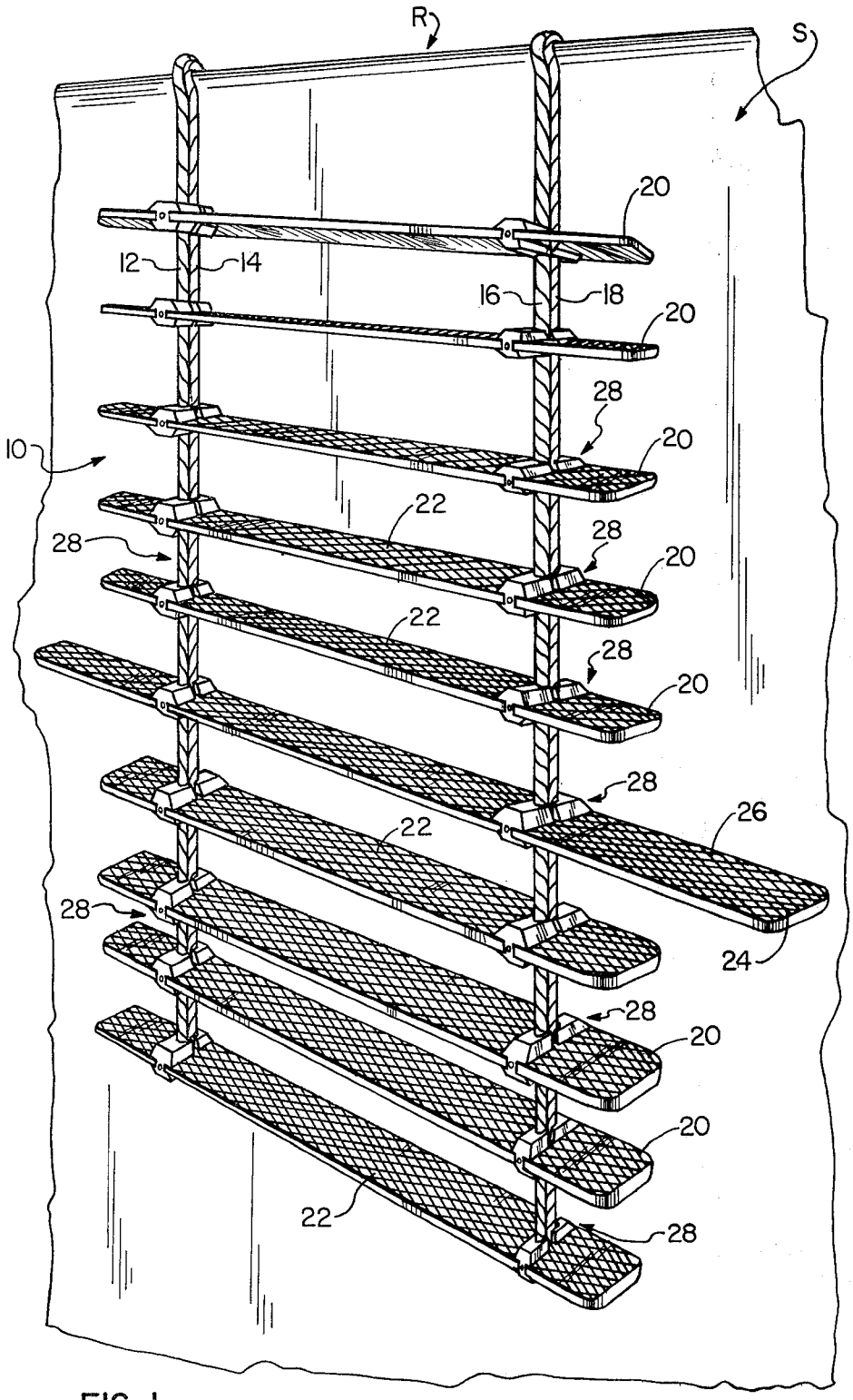
FIG. 1 is a pictorial representation of a ladder incorporating the principles of the present invention.

Referring now to the figures, and more particularly to FIG. 1 thereof, there is illustrated therein a collapsible ladder 10 constructed in accordance with the principles of the present invention. The ladder 10 is suspended from a rail R of a ship S by a plurality of rope segments 12, 14, 16, and 18. The rope segments 12, 14, 16, and 18 are fixed at their upper ends to the rail R in a suitable manner. The rope segments 12, 14, 16, and 18 can be part of the same rope, a pair of ropes, or can be individual ropes as desired and preferably are formed of a braided nylon material although hemp, steel cable or the like can be employed.

The rope segments 12 through 18 serve to suspend a plurality of elongated platforms 20 in a spaced apart substantially parallel relationship for use as a ladder. The elongated platforms 20 are preferably constructed of aluminum although suitable materials such as wood or plastic can be employed. To enhance the safety of the collapsible ladder 10 the upper face of each of the elongated platforms 20 is provided with a friction inducing surface 22.

In addition to the elongated platforms 20 provided, a spreader 24 having a friction including surface 26 is also suspended from the rope segments 12, 14, 16, and 18. The spreader platform is mounted substantially in the same manner as the elongated platforms 20, as will hereinafter be described, but it is longer in length. The spreader platform 24 also may be sized so that it is wider in width so that its rear edge can abut against the ship S to keep the narrower elongated platforms 20 away from the ship S and is so sized in length to preclude the twisting of the ladder 10 about its rope segments.

The rope segments 12, 14, 16, and 18 are clamped to the elongated platforms 20 and the spreader platform 24 by a plurality of clamps 28. The clamps 28 are each divided into clamp halves 30 and 32, as further illustrated in FIG. 4.

Figure 2:
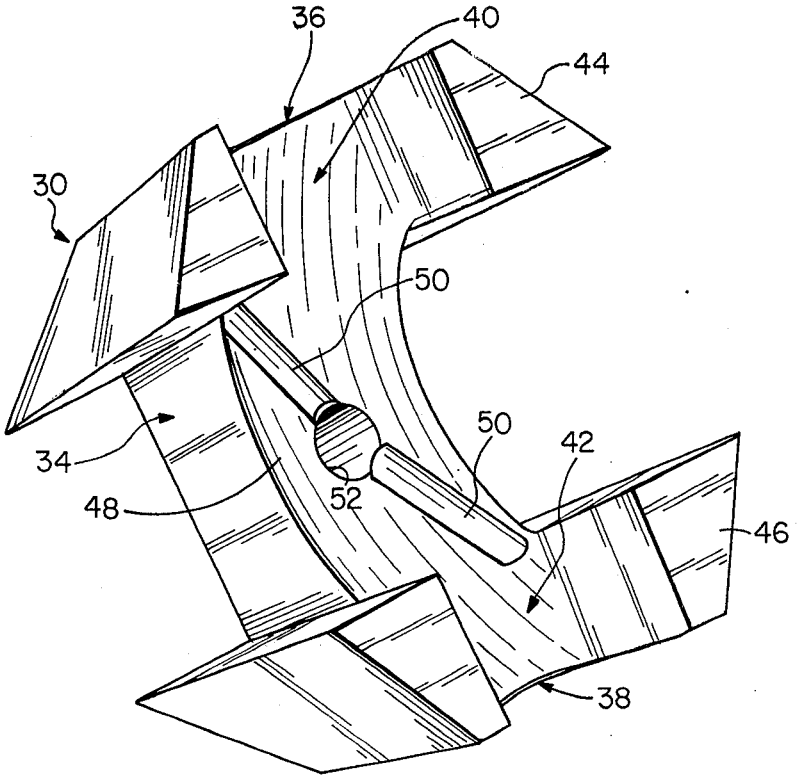
FIG. 2 is an enlarged perspective view of one half of the clamps of the present invention.
Figure 3:
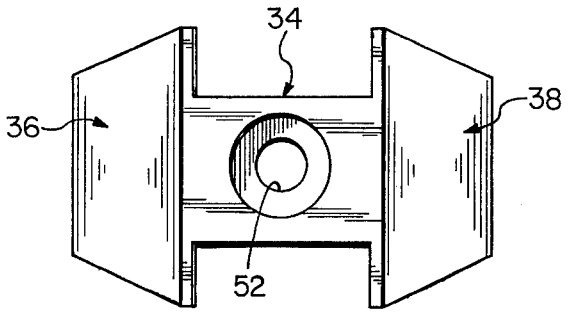
FIG. 3 is a rear view in elevation of the clamp of FIG. 2.

With reference to FIGS. 2 and 3, the nature of the clamp halves 30 and 32 of the clamps 28 can be clearly ascertained. Illustrated in FIGS. 2 and 3 is a clamp half 30 with the complementary clamp half 32, not shown, being substantially identical thereto, the ensuing description of clamp half 30 therefore also applying to clamp half 32. Clamp half 30 is substantially U-shaped and includes a bight portion 34 and a pair of leg portions 36 and 38. The bight portion 34 of the clamp half 30 is dimensioned for insertion into notches, hereinafter described, disposed in the platforms 20 and 24. The legs 36 and 38 include, respectively, rope receiving recesses 40 and 42 which open, respectively, through the ends 44 and 46 of the leg portions 36 and 38. The rope receiving recesses 40 and 42, in conjunction with the inner surface 48 of the bight portion 34 of the clamp 30, form the rope engaging portion of the clamp 30.

Formed with the inner surface 48 of the bight portion 34 of the clamp 30 is a ridge 50 designed to engage a portion of a spiral recess in the rope which the clamp engages, the spiral recess being formed by the braiding of the rope components. Similarly, alternate ridges or protusions can be employed to enhance engagement of the clamp 30 with the adjacent portion of the rope disposed therein when the collapsible ladder 10 is assembled. However, since the rope is precluded from lateral movement by the shape of the clamp 30, and the ridge 50 is disposed at an angle relative to the longitudinal axis of the rope when in position, very effective gripping of the rope is effected.

The leg portions 36 and 38 of the clamp 30 are wider than the bight portion 34 so that when the bight portion 34 is inserted into a notch disposed in the platforms 20 and 24 the leg portions 36 and 38 can engage the upper and lower faces of the platforms to retain the clamp 30 locked in position, the bight portion 34 being disposed within the notch.

Figure 4:
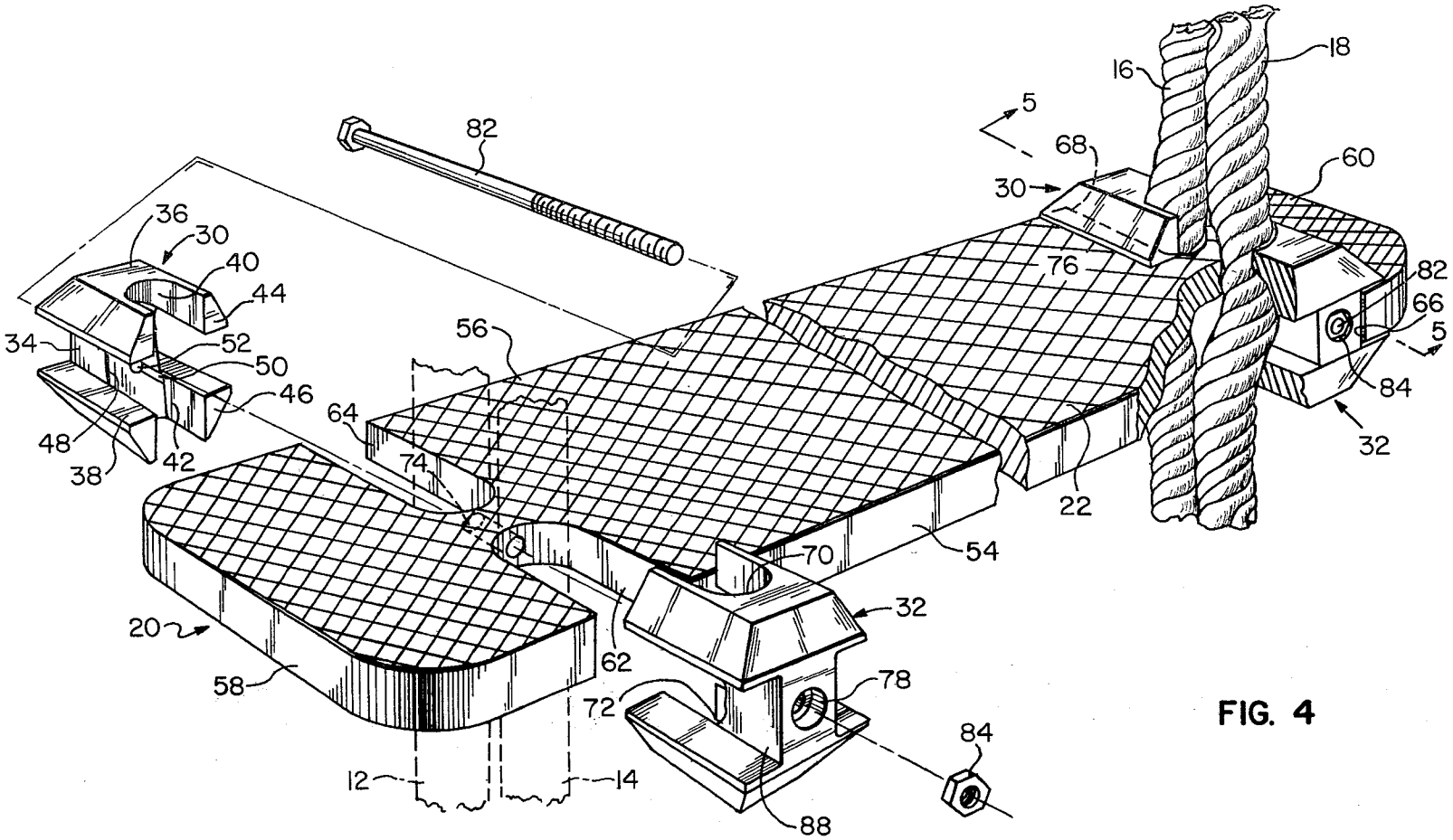
FIG. 4 is a fragmentary partially broken away perspective view of a pair of clamps of the present invention in a disassembled and assembled condition relative to one of the platforms of the present invention.

Disposed through the bight portion 34 of the clamp 30 is an aperture 52 through which an elongated fastener can be placed, as shown in FIG. 4. The aperture 52 preferably has a countersunk end diameter to accommodate the head of the fastener. The clamp halves 30 and 32 are preferably constructed of cast aluminum or the like although other suitable materials can be selected.

Figure 5:
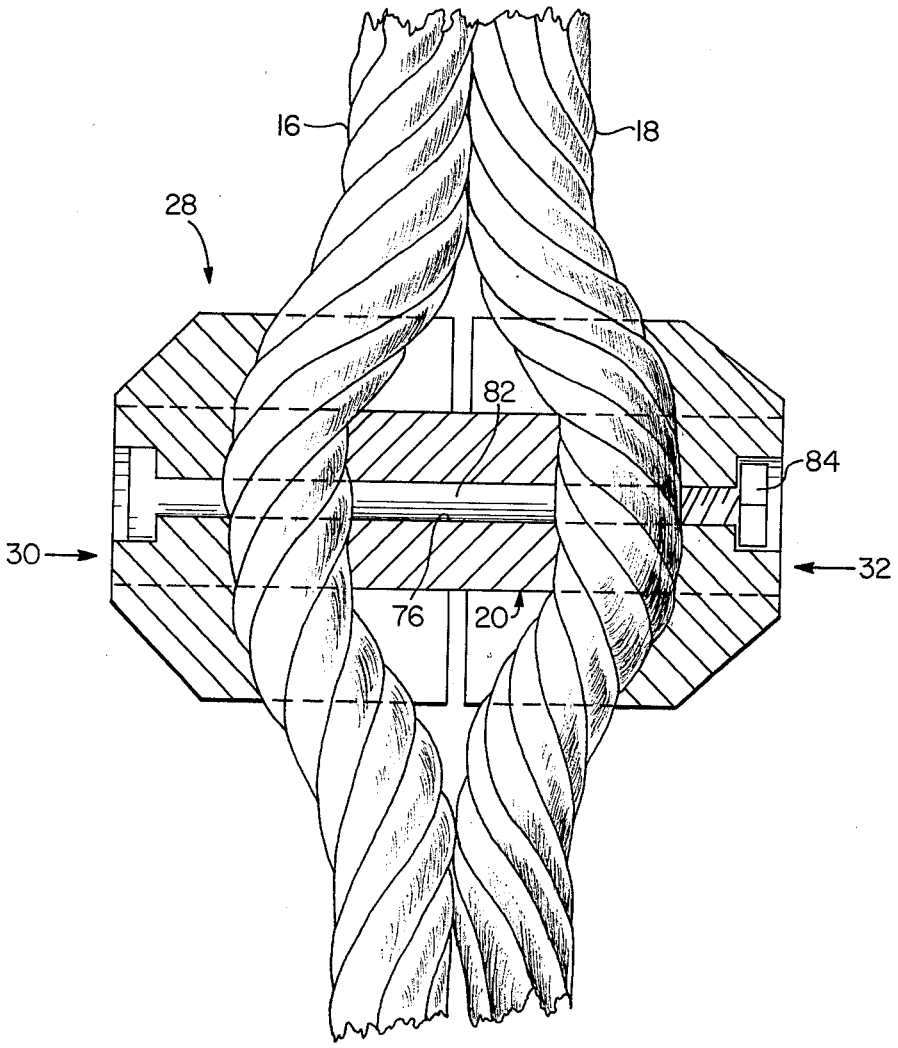
FIG. 5 is an enlarged fragmentary cross sectional view of the present invention taken substantially along the lines 5—5 of FIG. 4.

With reference to FIGS. 4 and 5, the manner in which the clamps 28 are fastened to an elongated platform 20, representative of all the platforms 20, can be observed. The clamps 28 are fastened to the spreader platform 24 in the same manner as to the elongated platforms 20 and therefore the following description in relation to the elongated platform 20 illustrated also applies to the spreader platform 24. Each elongated platform 20 includes a pair of spaced apart longitudinal side edges 54 and 56 and a pair of spaced apart transverse end edges 58 and 60. A first pair of adjacent notches 62 and 64 are disposed in the platform 20 adjacent to the end edge 58 and open, respectively, through longitudinal side edges 54 and 56 as well as through the faces of the platform 20. A second pair of adjacent notches 66 and 68 are disposed in the platform 20 adjacent to the end edge 60 thereof, the notches 66 and 68 opening, respectively, through longitudinal side edges 54 and 56 as well as through the faces of the platform 20.

The notches 62 through 68 are slightly larger in width than the diameter of the rope segments 12, 14, 16, and 18 and are rounded at the innermost portions thereof to have a curvature substantially similar to the outer curvature of the rope segments. The rope receiving recesses 40 and 42 of the clamp half 30 also have a width sized to accommodate the width of the rope segments. The rope receiving recesses 70 and 72 of the clamp half 32 are similarly sized.

An elongated passage 74 is disposed within the platform 20 between the innermost portions of each of the first pair of notches 62 and 64 and an elongated passage 76 is disposed in the platform 20 between the innermost portions of each of the second pair of notches 66 and 68. The passages 74 and 76 are located in the platform 20 such that they align with the aperture 52 in the clamp half 30 and an aperture 78 disposed in the clamp half 32 when the clamp halves 30 and 32 are positioned on the platform 20 with the bight portion 34 of the clamp half 30 disposed within the notch 64 and the bight portion 80 of the clamp half 32 disposed in the notch 62. This permits placement of a bolt 82 through the aperture 52, the elongated passage 74, and the aperture 78, in regard to the clamp 28 disposed in the first pair of notches 62 and 64, and permits the placement of another bolt 82 through the aperture 52, the elongated passage 76, and the aperture 78, in regard to the clamp 28 disposed in the notches 66 and 68. The bolts 82 are threaded and are each secured in position by complementary threaded nuts 84, the tightening of the nuts 84 drawing the clamp halves 30 and 32 together, as illustrated in FIGS. 4 and 5 by the clamp 28 disposed in the second pair of notches 66 and 68. The bolts 82 pass through the braids of the rope segments in a nondamaging fashion, this relationship tending to preclude slippage of the platforms 20 in relation to the rope segments.

When the halves of the clamps 28 are secured together by the bolts 82 and the nuts 84, the rope segments which pass through the platforms 20 are bent into a configuration wherein they extend partially around the faces of the platform 20 adjacent to the innermost surfaces of the associated notch. Therefore, each pair of rope segments which are clamped together by the clamps 28 tightly sandwich therebetween the portion of the platform 20 between the associated notches, further precluding slippage of the platform 20 relative to the rope segments without causing undue strain on the rope segments or a force which might tend to cut or weaken the rope segments.

Although the bolts 82 are illustrated as fastening together the clamp halves 30 and 32 in a particular manner it is to be understood that other than a longitudinal fastener can be employed so long as the clamp halves 30 and 32 are firmly drawn toward each other and are caused to reside within the associated notches. The exact number of rope segments employed and the positioning of the notches in the elongated platforms 20 and the spreader platform 24 as well as the number of spreader platforms 24 included in any particular collapsible ladder can be selected as desired by the user with the scope of the invention.

It will be understood that various changes in the details, materials, arrangements of parts and operational conditions which have been herein described and illustrated in order to explain the nature of the invention may be made by those skilled in the art within the principles and scope of the invention.

What is claimed is:

1. A collapsible ladder comprising:

a plurality of elongated platforms each having a pair of spaced apart longitudinal side edges and a pair of spaced apart transverse end edges, a first pair of adjacent notches being disposed in each of said platforms adjacent to one of said end edges, the first notch of said first pair of notches opening through one of said side edges of the associated said platform, the second notch of said first pair of notches opening through the other of said side edges of the associated said platform, a second pair of adjacent notches being disposed in each of said platforms adjacent to the other of said end edges, the first notch of said second pair of notches opening through one of said side edges of the associated said platform, the second notch of said second pair of notches opening through the other of said side edges of the associated said platform;

a plurality of rope segments extending between said elongated platforms for supporting said platforms in a spaced apart use position, selected portions of selected rope segments being disposed in said first and second pairs of notches; and a plurality of clamp means, some of said clamp means for clamping said selected portions of said selected rope segments in said first pairs of notches, the balance of said clamp means for clamping selected said rope segments in said second pairs of notches, each of said clamp means being divided into two halves, a rope engaging portion of each half of each of said clamp means being dimensioned for at least a portion thereof to reside within the corresponding said notch, each of said clamp means including means for securing the halves thereof together to wedge said selected portions of said rope segments between said rope engaging portions of said clamp means and said elongated platforms.

2. A ladder in accordance with claim 1, wherein each of said halves of said clamp means are substantially U-shaped and include a bight portion and a pair of leg portions, said bight portion being dimensioned for insertion in said notches, said leg portions each having a rope receiving recess opening through the ends thereof, the inside surface of said bight portion and the inside surfaces of said rope receiving recesses forming said rope engaging portion of each of said clamp means halves.

3. A ladder in accordance with claim 2, wherein each of said rope receiving recesses forces the associated said rope portion to bend partially around the innermost closed end of the associated said notch when engaged therewith to preclude slippage of said platforms along said rope segments.

4. A ladder in accordance with claim 2, wherein said leg portions of each of said halves of said clamp means are wider than the associated said bight portions, said leg portions engaging the face surfaces of the corresponding said elongated platforms.

5. A ladder in accordance with claim 2, wherein each of said platforms have disposed therein an elongated passage located between said first and second notches of said first pair of notches and an elongated passage located between said first and second notches of said second pair of notches, said securing means comprising an elongated fastener, said bight portion of each of said clamp means halves having disposed therethrough an aperture positioned such that when said bight portions are disposed in corresponding said notches, said apertures disposed in associated said clamp halves align longitudinally with each other and with the corresponding said elongated passage, each of said elongated fasteners for insertion in a pair of selected said aligned apertures and a corresponding said elongated passage.

6. A ladder in accordance in claim 5, wherein said elongated fasteners also pass through the adjacent said portions of said rope segments.

7. A ladder in accordance with claim 5, wherein said elongated fastener comprises a threaded bolt and complementary threaded nut.

8. A ladder in accordance with claim 5, wherein said rope segments each comprise braided strands, the braided strands forming spiral recesses therebetween, said rope engaging portions of each of said clamp means halves including a ridge dimensioned to reside within the adjacent said spiral recess in said rope segment which is disposed adjacent thereto when said clamp means are assembled on said platforms.

9. A ladder in accordance with claim 1, further comprising at least one elongated spreader platform, said spreader platform having a pair of spaced apart longitudinal side edges and a pair of spaced apart transverse end edges, the distance between said end edges of said spreader platform being longer than the distance between said end edges of said elongated platforms, a first pair of adjacent spreader notches being disposed in said spreader platforms between one of said end edges thereof and the center of said spreader platform, the first notch of said first pair of spreader notches opening through one of said side edges of said spreader platform, the second notch of said first pair of spreader notches opening through the other of said side edges of said spreader platform, a second pair of adjacent spreader notches being disposed in said spreader platform between one of said end edges thereof and the center of said spreader platform, the first notch of said second pair of spreader notches opening through one of said side edges of said spreader platform, the second notch of said first pair of spreader notches opening through the other of said side edges of said spreader platform, selected portions of selected rope segments being disposed in said first and second pairs of spreader notches, selected said clamp means clamping said selected portions of said selected rope segments in said first and second pairs of spreader notches.

10. A detachable step for use in conjunction with a hanging ladder including at least one rope segment, said detachable step comprising:

an elongated platform including first and second spaced apart longitudinal side edges, and a pair of spaced apart transverse end edges, said elongated platform having disposed therein at least a first pair of adjacent notches, the first notch of said first pair of notches opening through one of said side edges of said platform, the second notch of said first pair of notches opening through the other of said side edges of said platform; and clamp means for removably securing said platform to selected portions of said rope segment, said clamp means being divided into two halves, one half of said clamp means for clamping a selected portion of said rope segment within one of said pair of notches, the other half of said clamp means for clamping a selected portion of said rope segment within the other of said notches, a rope engaging portion of each half of said clamp means being dimensioned for at least a portion thereof to reside within the corresponding said notch, said clamp means including means for securing the halves thereof together to wedge said selected portions of said rope segments between said rope engaging portions of said clamp means and said elongated platform.

11. A detachable step in accordance with claim 10, wherein said rope engaging portion of said clamp means is substantially arcuate and forces said selected portion of said rope segment to bend partially around the innermost closed end of said at least one notch when engaged therewith to preclude slippage of said platform along said rope segment.

12. A detachable step in accordance with claim 10, wherein each of said halves of said clamp means are substantially U-shaped and include a bight portion and a pair of leg portions, said bight portion being dimensioned for insertion in said notches, said leg portions each having a rope receiving recess opening through the ends thereof, the inside surface of said bight portion and the inside surfaces of said rope receiving recesses forming said rope engaging portion of each of said clamp means halves.

13. A detachable step in accordance with claim 12, wherein each of said rope receiving recesses forces the associated said rope portion to bend partially around the innermost closed end of the associated said notch when engaged therewith to preclude slippage of said platform along said rope segments.

14. A detachable step in accordance with claim 12, wherein said leg portions of each of said halves of said clamp means are wider than the associated said bight portions, said leg portions engaging the face surfaces of said elongated platform.

15. A detachable step in accordance with claim 12, wherein said platform has further disposed therein a second pair of adjacent notches, the first notch of said second pair of notches opening through one of said side edges of said platform, the second notch of said second pair of notches opening through the other of said side edges of said platform, an elongated passage being located between said first and second notches of said first pair of notches and an elongated passage being located between said first and second notches of said second pair of notches, said securing means comprising an elongated fastener, said bight portion of each of said clamp means halves having disposed therethrough an aperture positioned such that when said bight portions are disposed in corresponding said notches, said apertures disposed in associated said clamp halves align longitudinally with each other and with the corresponding said elongated passage, each of said elongated fasteners for insertion in a pair of selected said aligned apertures and a corresponding said elongated passage.

16. A detachable step in accordance with claim 15, wherein said elongated fasteners also pass through the adjacent said portions of said rope segments.

17. A detachable step in accordance with claim 15, wherein said elongated fastener comprises a threaded bolt and complementary threaded nut.

18. A detachable step in accordance with claim 12, wherein said rope segments each comprise braided strands, the braided strands forming spiral recesses therebetween, said rope engaging portions of each of said clamp means halves including a ridge dimensioned to reside within the adjacent said spiral recess in said rope segment which is disposed adjacent thereto when said clamp means are assembled on said platform.

* * * * *

UNITED STATES PATENT AND TRADEMARK OFFICE

CERTIFICATE OF CORRECTION

PATENT NO. : 4,442,920

DATED : April 17,1984

INVENTOR(S) : Gronbeck et al.

It is certified that error appears in the above-identified patent and that said Letters Patent are hereby corrected as shown below:

Column 4, line 2, "including" should read -- inducing -- .

Column 7, line 18, "in" second occurrence -- with --.

Column 7, line 24, "claim 5" should read -- claim 2 -- .

Signed and Sealed this

*Eleventh* Day of *September 1984*

[SEAL]

*Attest:*

GERALD J. MOSSINGHOFF

*Attesting Officer*

*Commissioner of Patents and Trademarks*